United States Patent [19]

Milberger et al.

[11] Patent Number: 4,509,594

[45] Date of Patent: Apr. 9, 1985

[54] MUDLINE CASING HANGER ASSEMBLY

[75] Inventors: Lionel J. Milberger; Charles D. Bridges, both of Houston, Tex.

[73] Assignee: Vetco Offshore, Inc., Ventura, Calif.

[21] Appl. No.: 445,316

[22] Filed: Nov. 29, 1982

[51] Int. Cl.[3] ..... E21B 23/00

[52] U.S. Cl. ..... 166/208; 166/214; 285/3; 285/140

[58] Field of Search ..... 166/115, 206, 214, 208; 285/3, 4, 18, 140, 141, 142, 143

[56] References Cited

U.S. PATENT DOCUMENTS

| | | | |
|---|---|---|---|
| 2,941,599 | 6/1960 | Daffin | 166/214 |
| 4,139,059 | 2/1979 | Carmichael | 166/208 |
| 4,276,932 | 7/1981 | Saliger | 166/214 |
| 4,355,825 | 10/1982 | Leicht | 285/3 |

*Primary Examiner*—Stephen J. Novosad
*Assistant Examiner*—Michael Starinsky
*Attorney, Agent, or Firm*—Edward L. Kochey, Jr.

[57] ABSTRACT

A mudline casing hanger assembly wherein the collet (10) is retained on the hanger body (12) during running by tensile coupons (26). The lower portion (32) of the coupon is retained in slot (24) with collet slots (22) and hanger flowby slots (48) being aligned.

11 Claims, 3 Drawing Figures

MUDLINE CASING HANGER ASSEMBLY

BACKGROUND OF THE INVENTION

This invention relates to oil and gas well casing hanger apparatus and in particular to a casing hanger assembly for supporting the casing at the mudline of a subsea well.

In the drilling of oil and gas wells concentric casing strings are hung and cemented in place as the drilling progresses to increasing depths. When drilling a subsea well from a fixed platform it is desirable to support the casing weights from the mudline with a blowout preventer located at the platform. Risers extend from the blowout preventer to the support location of substantially the same size as the casing string itself.

In supporting additional casing within the previously-run string, a limited annular space is available for this support. Furthermore, the support must be arranged in such a was as to permit flow through the annular space to facilitate cementing operations.

It is known to run the new casing hanger with its string of casing with a diametrically compressible collet around it being urged outwardly. The collet includes specially-shaped support shoulders extending outwardly which engage grooves in the previously-set hanger body. The new casing hanger body then rests on this collet.

Means such as shear pins are required to carry the collet on the hanger body at least until it enters the casing below the BOP and sometimes to pull the collet down until it reaches the support elevation. Other systems use the load support shoulder to push the collet down after means are provided to constrain the collet until it enters the casing string.

As wells approach greater depths, increasing load must be carried through these hangers; and effective utilization of the available space and material with structures having minimum stress concentrations is desirable. The load supporting segments which enter the previously-run hanger body should be fully engaged despite any mud that may have previously accumulated therein. Furthermore, the load shoulder between the collet and the newly-run casing hanger body is preferably shaped to provide the most desirable stress distribution in the hanger body.

It is also desirable where possible to avoid shear mechanisms which will leave loose metal particles that end up falling down hole or become lodged in the mechanism.

SUMMARY OF THE INVENTION

A casing hanger assembly for supporting a casing string within and from a previously-run hanger comprises a cylindrical casing body surrounded by a diametrically compressible collet. The casing body has a downwardly-facing load shoulder around a substantial majority of the periphery and a first reduced diameter portion below the load shoulder which backs up the collet in the loaded condition. It also has a second and smaller reduced diameter portion below the first reduced diameter portion as a recess for the collet while running the hanger.

The collet surrounding the casing body is movable axially from the reduced diameter portion to the load shoulder. The collet has the support segments at the upper end which are engageable with the previously-run hanger body. There is an upwardly-facing load shoulder at the top of the collet adapted to engage the downwardly-facing load shoulder of the casing hanger body. The collet preferably has downwardly-opening slots at a plurality of locations around its circumference.

A tension coupon is secured to the casing hanger body at its lower end and to the collet at its upper end. A weakened section in the tensile coupon provides sufficient strength to draw the collet down the casing riser but insufficient strength to carry the casing string load. Accordingly, after the casing hanger has been set and the load placed on the apparatus, the coupons break in tension.

Preferably the longitudinal dimensions are such that the remaining portions of the coupon continue to interact with the collet to maintain relative alignment between the collet and the hanger body. This makes it possible to align upper slots in the collet with flowby slots in the casing hanger body.

DESCRIPTION OF THE PREFERRED EMBODIMENT

Figure 1:
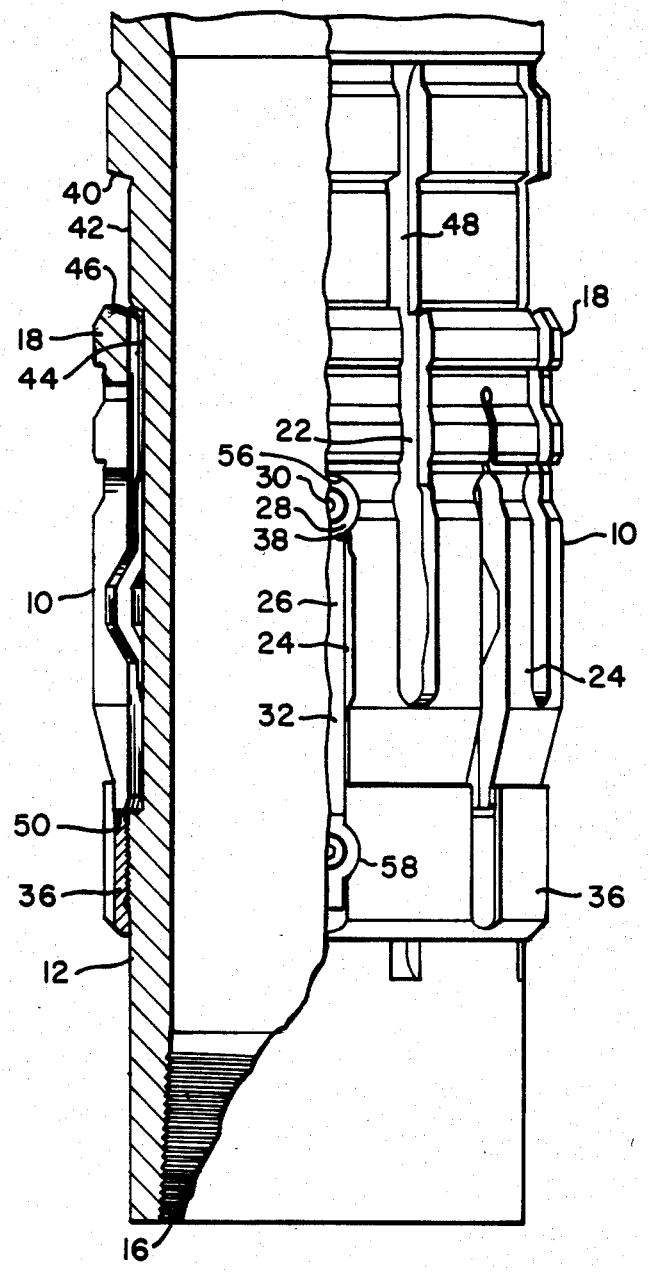
FIG. 1 is a split view with the right side being an elevation of the casing hanger assembly and the left side being a sectional view.

A diametrically compressible support collet 10 is secured to a casing hanger body 12. The casing hanger body supports casing string (not shown) by threads 16 at its lower end.

The collet has outwardly-extending latches 18 which are adapted to mate with the corresponding groove in a tubular member such as an earlier-run casing hanger (not shown). The preferred collet form has alternating slots such as upwardly-opening slot 22 and downwardly-opening slot 24. The collet is, therefore, diametrically compressible without circumferential movement as occurs in C-shaped collets.

For the purpose of running the casing hanger, the collet is secured to the casing hanger by two or more tensile coupons 26. The upper end 28 is attached to the collet 10 by bolt 30 and fits in a recessed portion within the collet. The lower end 32 of the tension member is attached to the hanger body by bolt 34. A retaining ring 36 is threaded on the lower end of the casing hanger body so as to centralize the collet in its lower position, and also to engage the lower end of the tensile coupons and entrap them against rotation around any horizontal axis.

The tensile coupons are each in the form of an elongated plate with its minor dimension radial to the collet so that it is flexible in that direction. It can be seen that the coupon is stiff in the circumferential direction and is also arranged to resist rotation in this direction around any point. The coupon also has a weakened section 38 located between the attaching means 30 at the top of the coupon and attaching means 34 at the lower end of the coupon. This weakened section is designed so that it is sufficiently strong to draw the collet into and through a riser string but is insufficiently strong to carry the casing weight.

The casing hanger body 12 has a downwardly-facing load shoulder 40 at an upper elevation with the casing hanger body having a first diameter 42 therebelow. Further below this but above the lower attaching means for the tensile coupon is a further reduced diameter portion 44. The tensile coupons are arranged to hold the collet adjacent this reduced diameter.

When running through the BOP, the collet 10 is secured to and drawn down by the tension coupons 26. As the hanger is further lowered, it enters the casing tieback string wherein the collet 10 is diametrically compressed; and tension coupons 26 flex inwardly to permit the compression while the collet is further drawn downwardly.

As the hanger reaches the support elevation, the collet 10 springs outwardly engaging the mating grooves in the earlier-run casing hanger. At this time tensile coupons 26 are still intact and permit the collet to flex outwardly for engagement. Further lowering of the casing string places the load of the casing string on the tensile coupons 26. These coupons break in tension and the string is lowered until load shoulder 40 rests on the upwardly-facing support shoulder 46 of the collet. Both the upper portion 28 and the lower portion 32 of the tension coupon 26 are retained and, therefore, cannot drop downhole to interfere with any further operations.

Tension load breakage is more controllable than shear breakage, primarily because of the unambiguous load pattern on the coupon. In shear members, variation in clearance between the shearing surfaces can vary the load pattern.

The tensile coupon 26 is of dog bone shape with boss 52 at the upper end and boss 54 at the lower end. Mating circular recesses 56 in the collet and 58 in the retaining ring engage the respective bosses. The load is transferred between the recess surfaces and the bosses, so that the retaining screws 30 and 34 take no significant load. Tensile coupon 26 has slightly oversized holes to avoid inadvertent load carrying by the screws.

In the preferred embodiment the upper end 28 of the tensile coupon 26 and the collet 10 therefore have interengaging load bearing surfaces in addition to retaining means 30. The lower end 32 of the tensile coupon and the hanger body 12 also have interengaging load bearing surfaces, acting thru ring 36, in addition to the retaining means 34.

If it must be removed or recocked for any reason, the tensile coupons are easily replaceable. They may be loaded in by simply removing the broken pieces and installing a new coupon under screws 30 and 34.

The hanger body 12 also has a flowby slots 48 past the load shoulders 40 to permit flowby during running and also during cementing operations after the hanger has been landed. The tension coupons are arranged so that collet 10 is maintained with the upwardly-opening slots 22 in alignment with the flowby slots 48. This permits full use to be made of the load bearing surfaces without interferring with flowby capacity.

Figure 3:
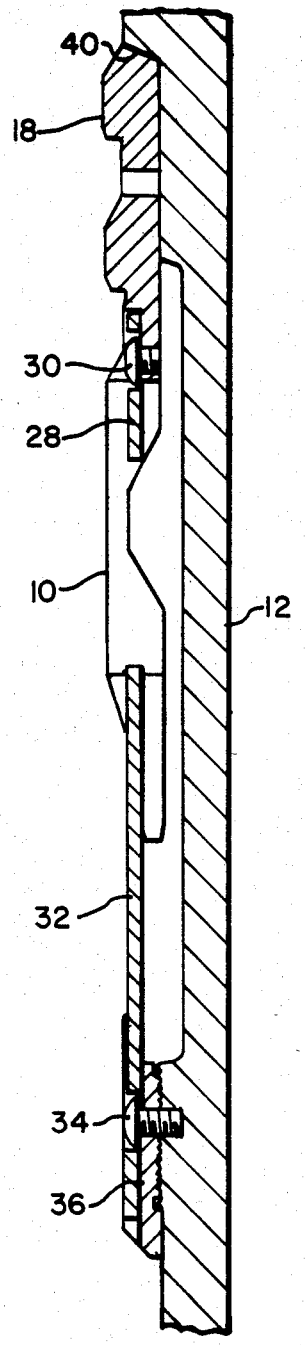
FIG. 3 is a sectional view showing the broken coupon with the hanger landed.
Figure 2:
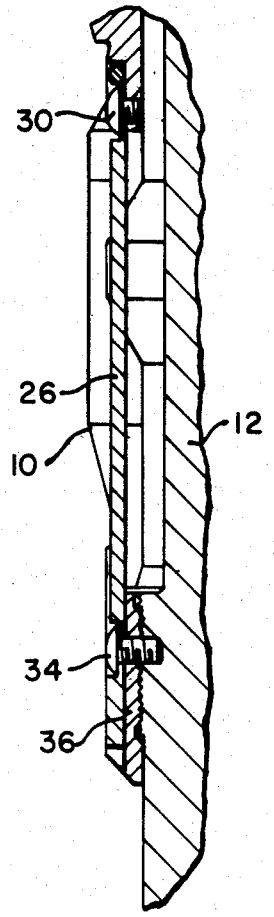
FIG. 2 is a sectional view through FIG. 1 showing the coupon intact.

FIG. 3 illustrates the condition after the hanger is set and the coupon has been broken. It can be seen that lower portion 32 of the tension coupon remains in one of the downwardly-opening slots 24 of the collet. Since the lower attaching means is arranged in such a way as to prevent rotation of this coupon around any horizontal axis, the coupon is held upright and, accordingly, maintains alignment between the collet and the hanger body. This is further accomplished since the distance between the support shoulder 46 of the collet and the load shoulder 40 in the running condition is less than the distance between the weakened section 38 of the coupon and the bottom 50 of the collet.

We claim:

1. A casing hanger assembly for supporting a casing string within and from a tubular member comprising: a cylindrical hanger body having a downwardly-facing load shoulder at an upper elevation, first attaching means at a lower elevation, means for supporting a casing string from said hanger body, and a reduced diameter portion between said load shoulder and said first attaching means; a diametrically compressible collet surrounding said hanger body at said reduced diameter portion having, an upwardly-facing support shoulder at the upper end adapted to support said load shoulder, outwardly-extending latch means adapted to engage mating grooves in the tubular member, and a second attaching means located on the collet; a plurality of tensile coupons, each comprising a vertically elongated member attached to said first and second attaching means, and having a weakened section between the attached ends, said weakened section being strong enough to pull the collet into and through a riser casing but weak enough to break when the load of the casing string is imposed.

2. A casing hanger assembly as in claim 1: said tensile coupons each being an elongated plate with their minor dimension radial to said collet, whereby said coupon is flexible in the radial direction and stiff in the circumferential direction.

3. A casing hanger assembly as in claim 2: said collet having a plurality of downwardly-opening slots, each of said tension coupons passing through said slots.

4. A casing hanger assembly as in claim 3: wherein said second attaching means holds said tensile coupons against rotation around a horizontal axis, whereby each coupon is maintained vertical even after breaking of the coupon.

5. A casing hanger assembly as in claim 4: said hanger body having an intermediate diameter portion between said reduced diameter portion and said load shoulder, said collet being held below said intermediate portion when said tensile coupons are intact; the distance between said support shoulder in the recessed position and said load shoulder being less than the distance between said weakened section of the coupon and the bottom of said collet, whereby said tension coupon maintains alignment of said collet even after breakage.

6. A casing hanger assembly as in claim 5: wherein said collet has overlapping alternately upwardly- and downwardly-opening slots, whereby said collet compresses without circumferential movement.

7. A casing hanger assembly as in claim 6: said hanger having flowby slots past said load shoulder, the upwardly-opening slots of said collet being aligned with the flowby slots.

8. A casing hanger assembly as in claim 1: the upper end of each tensile coupon and said collet having interengaging load bearing surfaces, and the lower end of each tensile coupon and hanger body having interengaging load bearing surfaces in addition to means for retaining the upper and lower ends of each coupon to said collet and hanger body, respectively.

9. A casing hanger assembly as in claim 4: the upper end of each tensile coupon and said collet having interengaging load bearing surfaces, and the lower end of each tensile coupon and hanger body having interengaging load bearing surfaces in addition to means for retaining the upper and lower ends of each coupon to said collet and hanger body, respectively.

10. A casing hanger assembly as in claim 5: the upper end of each tensile coupon and said collet having interengaging load bearing surfaces, and the lower end of each tensile coupon and hanger body having interengaging load bearing surfaces in addition to means for retaining the upper and lower ends of each coupon to said collet and hanger body, respectively.

11. A casing hanger assembly as in claim 7: the upper end of each tensile coupon and said collet having interengaging load bearing surfaces, and the lower end of each tensile coupon and hanger body having interengaging load bearing surfaces in addition to means for retaining the upper and lower ends of each coupon to said collet and hanger body, respectively.

* * * * *